US008069928B2

(12) United States Patent
Birath

(10) Patent No.: US 8,069,928 B2
(45) Date of Patent: Dec. 6, 2011

(54) PERCUSSION DEVICE, DRILLING MACHINE INCLUDING SUCH A PERCUSSION DEVICE AND METHOD FOR CONTROLLING SUCH A PERCUSSION DEVICE

(75) Inventor: Peter Birath, Vintrosa (SE)

(73) Assignee: Atlas Copco Rock Drills AB, Orebro (SE)

( * ) Notice: Subject to any disclaimer, the term of this patent is extended or adjusted under 35 U.S.C. 154(b) by 243 days.

(21) Appl. No.: 12/309,987

(22) PCT Filed: Sep. 12, 2007

(86) PCT No.: PCT/SE2007/000794

§ 371 (c)(1),
(2), (4) Date: Feb. 5, 2009

(87) PCT Pub. No.: WO2008/033075

PCT Pub. Date: Mar. 20, 2008

(65) Prior Publication Data

US 2009/0321099 A1 Dec. 31, 2009

(30) Foreign Application Priority Data

Sep. 13, 2006 (SE) ..... 0601879

(51) Int. Cl.
*B25D 9/16* (2006.01)
*B25D 9/18* (2006.01)

(52) U.S. Cl. ..... 173/1; 173/135; 173/138; 173/206; 173/208; 91/277; 91/278; 91/293; 91/294; 91/298; 251/26; 251/28; 251/31; 137/625.6; 137/625.66

(58) Field of Classification Search ..... 173/1, 135, 173/138, 206, 208; 91/277–278, 293, 294, 91/297, 298; 137/625.6, 625.66; 251/26, 251/28, 31

See application file for complete search history.

(56) References Cited

U.S. PATENT DOCUMENTS

| | | | | |
|---|---|---|---|---|
| 3,552,269 | A * | 1/1971 | Arndt | 91/277 |
| 3,741,072 | A * | 6/1973 | Romell et al. | 91/290 |
| 3,780,621 | A * | 12/1973 | Romell | 91/290 |
| 3,805,896 | A * | 4/1974 | Bauer | 173/16 |
| 4,342,255 | A * | 8/1982 | Watanabe et al. | 91/40 |
| 4,413,687 | A * | 11/1983 | Eklof | 173/207 |
| 4,800,797 | A * | 1/1989 | Comarmond | 91/307 |
| 5,056,606 | A | 10/1991 | Barthomeuf | |
| 6,371,222 | B1 * | 4/2002 | Andersson et al. | 175/135 |

FOREIGN PATENT DOCUMENTS

| | | | |
|---|---|---|---|
| DE | 10237407 | A1 | 4/2004 |
| EP | 0578623 | A2 | 1/1994 |
| EP | 0947294 | A2 | 10/1999 |
| WO | WO 91/17023 | | 11/1991 |
| WO | WO 2004/073932 | A1 | 9/2004 |

* cited by examiner

*Primary Examiner* — Rinaldi I. Rada
*Assistant Examiner* — Michelle Lopez
(74) *Attorney, Agent, or Firm* — Mark P. Stone

(57) ABSTRACT

A percussive device and method having, inside a machine housing (3), a reciprocally moveable percussive piston (2), the movement of which is controlled by a control valve (5), which is arranged to alternatively connect a chamber to a pressure source and to low pressure in dependence on a signal corresponding to the axial position of the percussive piston, and a valve (16) arranged to allow adjustment of the axial position of the percussive piston at which the signal is transmitted, by opening and blocking of a connection between one or more control channels (10, 11, 12, 13) and the control valve.

19 Claims, 10 Drawing Sheets

PERCUSSION DEVICE, DRILLING MACHINE INCLUDING SUCH A PERCUSSION DEVICE AND METHOD FOR CONTROLLING SUCH A PERCUSSION DEVICE

FIELD OF THE INVENTION

The invention concerns a percussion device according to the preamble of claim 1. The invention also concerns a rock drilling machine including such a percussion device.

BACKGROUND OF THE INVENTION

EP-0 080 446 (Atlas Copco AB) discloses a rock drilling machine, wherein the feeding force is transmitted from the housing to the drill string or the drill string adapter over a damper. The damper yields from the reflected compressive shock waves and the yield is detected and used to control a control pin which adjust the stroke length for the percussive piston such that the reflective shock wave energy is minimized.

In particular, the control pin is an adjustment means which adjusts in what axial position of the percussive piston a pressure signal is transmitted to a to-and-fro moveable valve body, wherein means are arranged in order to control the control pin as a response to the pressure signal such that the operation of the percussion device is modified for reduction of reflected shock wave. In an alternative embodiment the control pin is controlled after analysis of a drilling parameter in connection to the drill string.

The known drilling machine functions well but is gives limited possibilities to easily control the axial turning-positions of the percussive piston.

THE AIM AND MOST IMPORTANT FEATURE OF THE INVENTION

It is an aim of the present invention to provide a percussive device of the kind indicated above, which is an improvement of the known percussive device. In particular it is an aim of the invention to provide a percussion device with simpler and more secure adjustment possibilities as concerns the movement of a percussive piston.

This aims are obtained according to the invention through the features of the characterizing portion of claim 1.

Hereby is achieved that a distinct adjustment of the stroke length of the percussive piston is possible in a secure manner. This is a great advantages, since the possibility is provided to simply control the stroke length by emitting simple, uncomplicated on (and possible off) signals to the valve elements in order to vary percussive energy emitted from the percussion device as a response to the requirements that exists in the particular operating situations. This as a contrast to the back ground art, wherein a valve body is moved between several different axial positions for the respective opening of several axially separated control channels.

If it is desired to change the striking position of a percussion device, the setting channel (control channel) for high pressure can be moved rearward, i.e. in the direction away from the drill shank, which results in longer strike length and more power in each strike. Given the same pressure it takes longer time to accelerate the piston when the strike length is longer, which results in drilling with a lower frequency.

Generally it can be said to be a desire to vary the percussive energy of the percussion device according to the variations of the hardness of the rock. In particular it is desired to control the percussion device in this respect after the requirements that exist in an actual portion of a rock. Through the invention, the percussion device can be controlled with simple means in the direction of optimizing drilling and reduction of shock wave reflexes, which the drilling process does not benefit from.

In general for a drilling process there are indications to the extent that drilling with a new drill bit is preformed with too high percussive energy. This because with a new drill bit, only a smaller portion of the actuation units of the drill bit will come into actual engagement with the rock. After a certain wear of the drill bit, however, the percussive energy will gradually automatically be adjusted to a somewhat worn shape of the engagement portions of the drill bit, whereby the efficiency of the drilling process will increase. With continued wear of the drill bit, the efficiency will, however, drop again because of less good adaption of the percussive energy to the actual appearance of the drill bit.

The invention makes it possible to take account of this phenomenon and that a percussive energy is controlled in order to be better adapted to the state of wear of the drill bit. These gives the possibility to achieve increased drilling rate with the same percussive effect, reduced strain in the drill steel, less reflexes from the rock, which in turn can result in that a smaller damping unit will be necessary. Through the invention, a drilling machine can be easily adapted to varied drill bit wear, rock strength and drill bit size. The drilling machine can hereby be set in advance for certain of the parameters which are known or be controlled during drilling after need and sensed parameters.

In a preferred embodiment of the invention, the control is possible as a response to a parameter describing the drilling process, such as for example drilling rate or pressure in a damping chamber or as a result of shock wave amplitude, measured through shock wave measurements.

Further advantages are obtained through further aspects of the invention, which will be apparent from the following description of an embodiment.

DESCRIPTION OF DRAWINGS

The invention will now be described in greater detail by way of embodiments and with reference to the annexed drawings, wherein.

DESCRIPTION OF EMBODIMENTS

Figure 1:
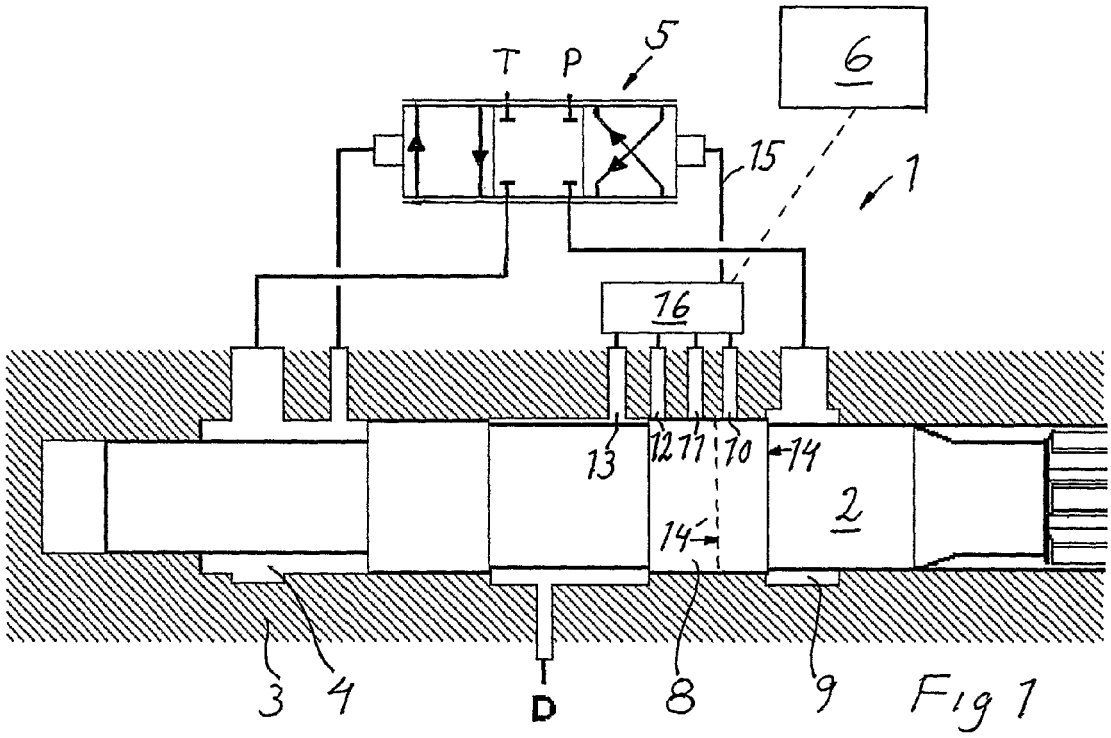
FIG. 1 shows grammatically, in an axial section, a part of a drilling machine including a percussion device according to the invention.

FIG. 1 shows a part of a rock drilling machine 1 including a percussion device with a percussion piston 2. A valve for switching pressure medium for driving the percussive piston is indicated with 5. Further is included a central positioning unit 6 and a rotation unit, a damping unit etc. which are not shown on FIG. 1. The percussive piston 2 is reciprocally moveable inside the machine housing 3.

In the machine housing 3 there are, in the area of a percussive piston land 8, a number of control channels 10-13 which are arranged to co-operate, with their channel openings, with a first edge 14 of the percussive piston land 8. An interrupted line indicates at 14' a position of the first edge 14 when the percussive piston has retracted after a strike so that the opening to the control channel 10 is uncovered.

A chamber 4 that can be pressurized receives in a per se known manner a drive face on the percussive piston in the form of drive flank of a percussive piston land.

For chosen communication between the different control channels and a signal conduit 15, which leads to the valve 5 for switching the movement direction of the percussion device, there is arranged a valve means 16, the function of which is explained below.

The percussive piston 2 is actuated by high fluid pressure in the chamber 4 towards a striking position in order to initiate a strike in the direction to the right, as seen in the Figure, in a per se known manner, against a drill shank. In the return chamber 9, which receives a flank of a percussive piston land having a surface being smaller than the surface of the flank in the chamber 4, there prevails during operation, in a manner known per se, during the return drive of the percussive piston, the high pressure.

When the drive chamber 4, by switching of the valve 5 is drained to tank, thereby occurs a return drive of the percussive piston 2 such that it after a while has been moved in the direction to the left, as seen in FIG. 1, into a position where the control edge 14 is in the shown position 14', as an example. Hereby the higher pressure in the chamber 9 will be transmitted to the signal conduit 15, over one of the control channels 10-13, which is chosen, for switching the valve 5 to the left, as seen in the Figure, in order to transmit high pressure to the chamber 4 and thereby initiation of a new strike.

Figure 2:
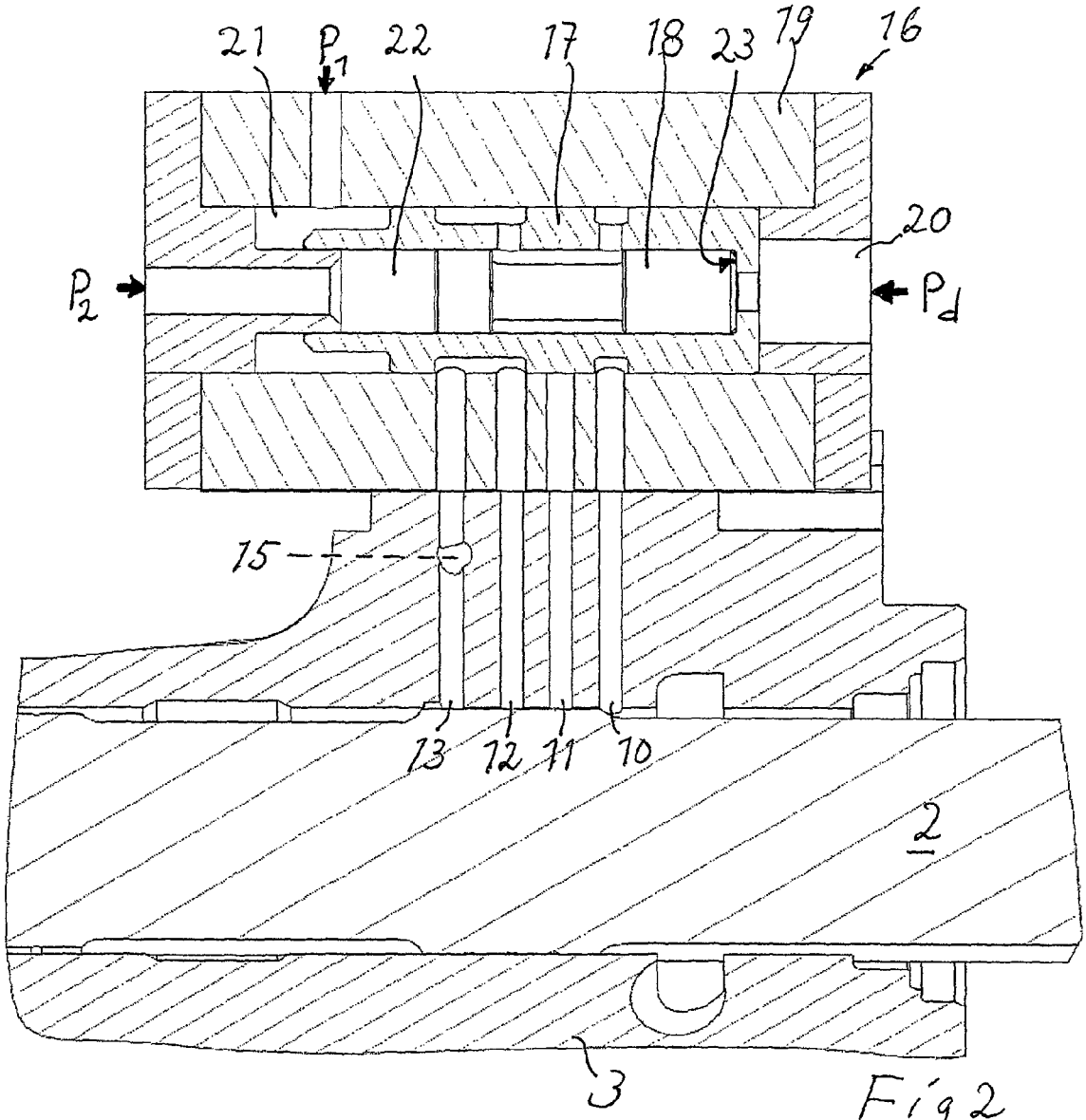
FIG. 2 shows diagrammatically, in an axial section, a valve means according to the invention in a percussion device.

FIG. 2 shows the valve means 16 according to a first embodiment, wherein two concentric valve elements control how the control channels 10-13 communicate with the signal conduit 15.

The valve means 16 includes a first valve element 17 and, arranged concentrically inside this, a second valve element 18. Both valve elements have cylindrical general configuration and are moveable axially as desired. A valve housing 19 which receives the valve elements, exhibits at its right flank end a constant pressure chamber 20, inside which prevails a pressure $P_d$, permanently acting on both valve elements, which thus from this pressure are pressed to the left as seen in FIG. 2.

The first valve element 17 has on its opposite, left, side a first control chamber 21, which at choice is fed with a first pressure $P_1$ which is of such a magnitude that the pressurizing of the first control chamber 21 displaces the first valve element from the shown position to a position to the right against the action of the pressure $P_d$. A second control chamber 22 is arranged, at choice, to be pressurized by a second pressure $P_2$, which is able to press the second valve element 18 to the right against the action of the pressure $P_d$. In this embodiment this means resting against an inward shoulder 23 on the first valve element 17. Other solutions with completely independent first and second valve elements are within the scope of the invention.

In FIG. 3*a* to 3*d* the function of the valve in FIG. 2 is explained in greater detail.

Figure 3A:
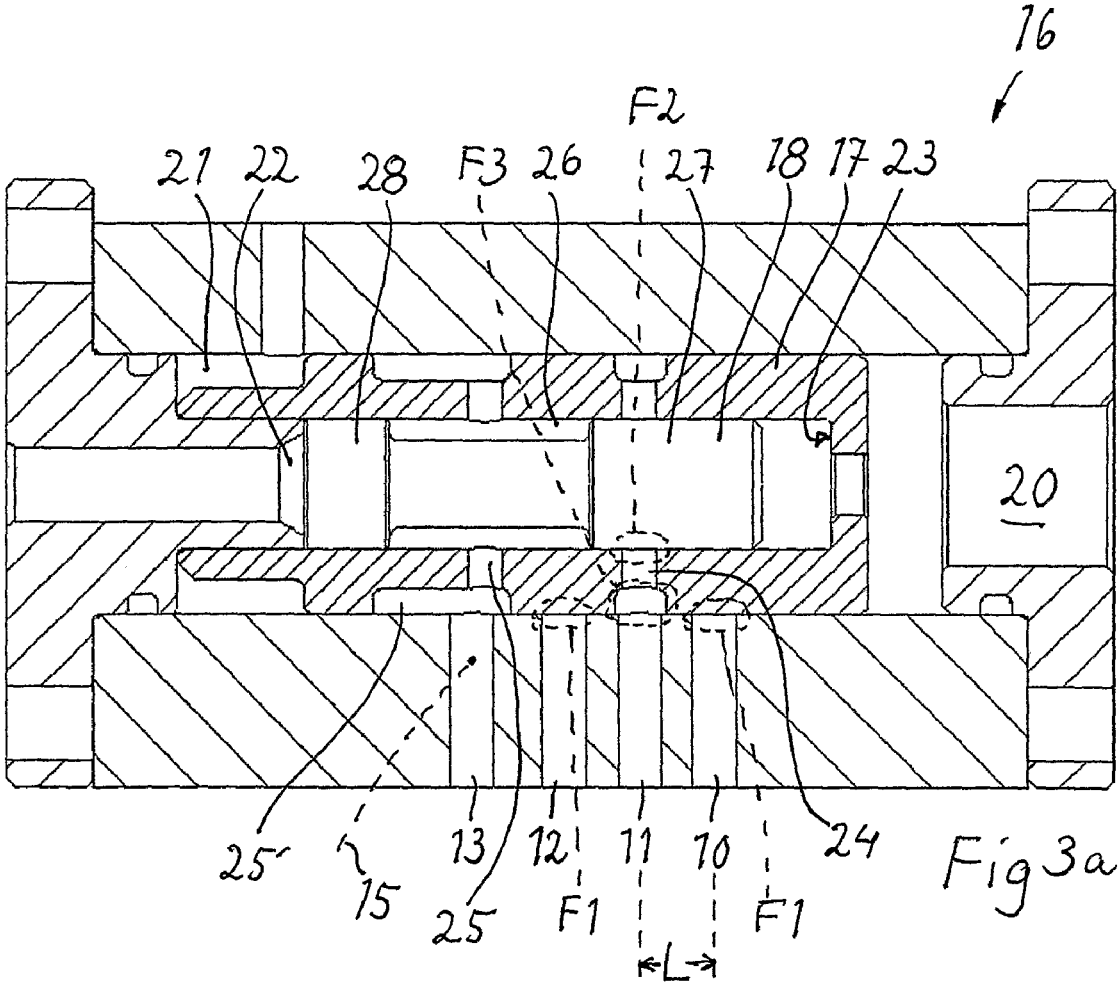
FIG. 3*a-d* shows in sections the valve means in FIG. 2 in different positions.

The valve means 16 is in FIG. 3*a* shown in a position when the "uppermost" situated control channel 13 alone is in connection with the signal conduit 15, which it is permanently through a permanent communication. The other control channels 10-12 are blocked.

It shall here be emphasised that the term open in this connection means that channel portions of a connection between the control channel and the respective control channels is open for the possibility of fluid transmission. It is, however, not excluded that a control channel having a channel portion open can be included in a connection which is blocked as seen totally along its extension by the effect of a second valve element blocking a second channel portion.

In FIG. 3*a* the first valve element 17 is shown in its first position, wherein first portions F1 of connections between a first subset 10 and 12, of the control channels and the control valve 5 are blocked by this first valve element 17. No (or a lower) control pressure prevails in each one of the control chambers 21 and 22. The second valve element 18 is shown in its first position, wherein a second portion F2 of a connection between a second subset 10 (/11) of the control channels and the control valve 5 is blocked.

In the embodiment in FIG. 3*a*, the first valve element is constructed such that a portion F3 of connection between the control valve and a control channel 11 from the second subset is open. The position of the second valve, however, blocks according to the above the further connection with a control valve 5. Hereby only the control channel 13 is in connection with the control valve 5, whereas the second control channels 10, 11 and 12 are blocked along their connections.

The control channels 10-13 are axially separated with the same spacing, and the distance between the channel portions 24 and 25 in the first valve element (approximately) corresponds to the distance 2×L, wherein, in this embodiment, L is the distance between centres of two adjacent control channels. It should be noted that a differently constructed embodiment can be designed with a variation of distance between the different openings in order to achieve a desired characteristic of the percussion device.

Reference numerals 24' and 25' concern surrounding turned out grooves in the cylindrical outer wall of the first valve element in per se known manner for valve bodies of similar kind. The turned out groove 25' has an axial extension which (about) corresponds to L for reasons that will appear below.

The second valve element 18 exhibits two piston portions 27 and 28 sealing against an inner cylindrical space in the first element 17, and the intermediate, turned out groove 26, has a width exceeding 2×L. It should be observed that channeling from the control channels can be arranged such that mutual distances between openings in the valve means 17 deviate from distance between the openings in the percussive piston cylinder.

Figure 3B:
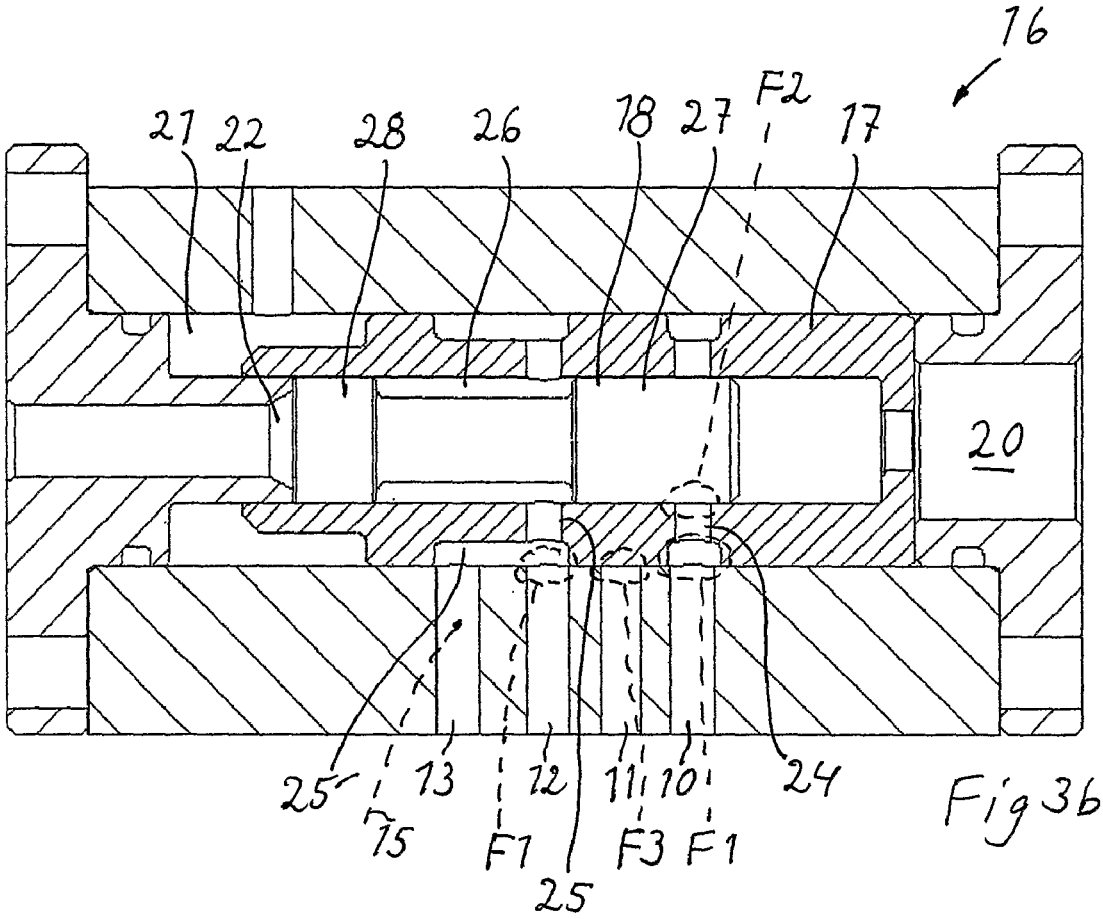

In FIG. 3*b* prevails a control pressure $P_1$ in the control chamber 21 but no (or a lower) control pressure in the control chamber 22. The first valve element 17 is switched to a second position, wherein the channel portions 24 and 25 are in open connection with the control channels 10 and 12 respectively. The control channel 11 is, however, locked and the turned out groove 25' transmits fluid connection through open connection with each one of the control channels 12 and 13. The portions F1 are open.

The second valve element 18 is still in its first position and blocks through its piston portion 27 the channel portion 24. The second portion F2 is blocked. In the shown position, both control channels 12 and 13, but not the control channels 10 and 11 have fluid connection with the signal conduit 15.

Figure 3C:
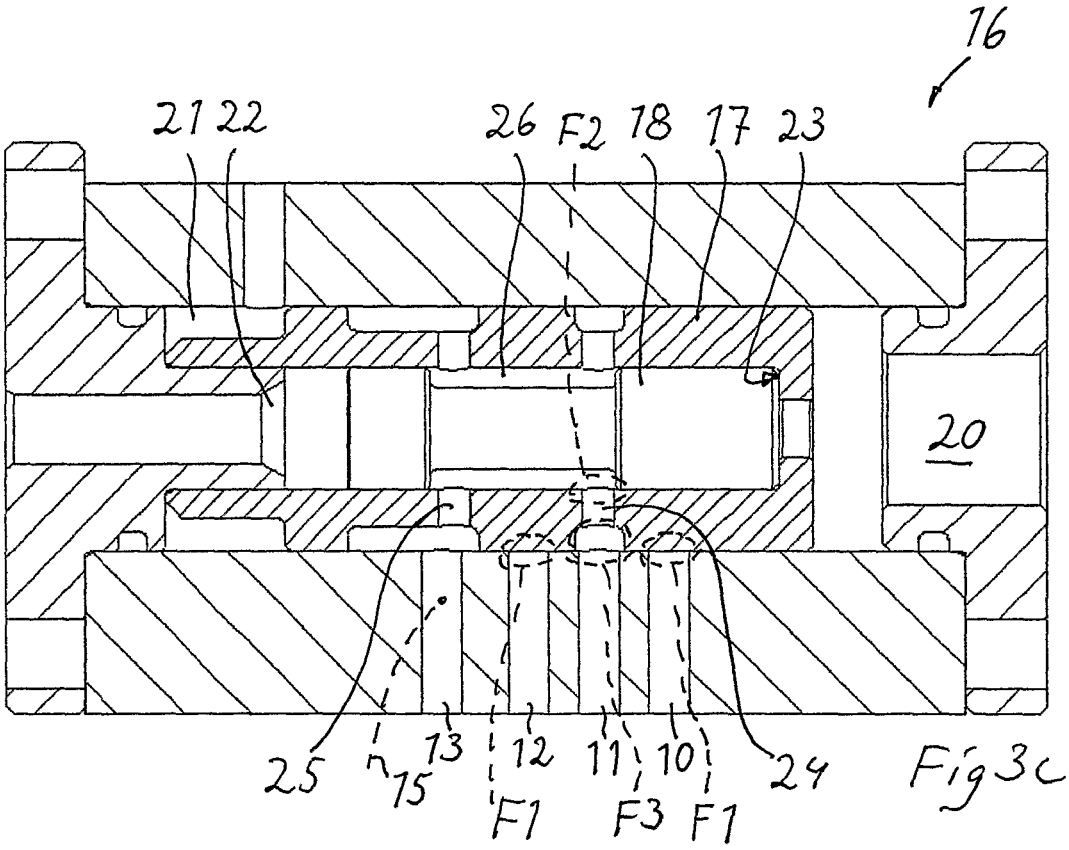

In FIG. 3*c* there prevails no (or a lower) control pressure inside the control chamber 21, but the control pressure $P_2$ prevails in the control chamber 22. The first valve element 17 is in the first position, the same as in FIG. 3*a*, whereas the second valve element 18 is in a second position, with its axial end, positioned towards the not shown drill shank, lying against the inwardly directed shoulder 23 in the first valve element. Said second portion F2 is open. A channel 26 being formed by a turned out cavity in the second valve element 18 and the inner surface of the first valve element 17 together with the upper parts of the channel portions 24 and 25 constitutes an open connection over said second portion F2. The result of this is at the control channel 11 over the channel portion 24, the turned out cavity 26 and the channel portion 25 has fluid connection with the control channel 13 and thereby with the signal conduit 15. The control channel 10 is blocked along its extension.

Figure 3D:
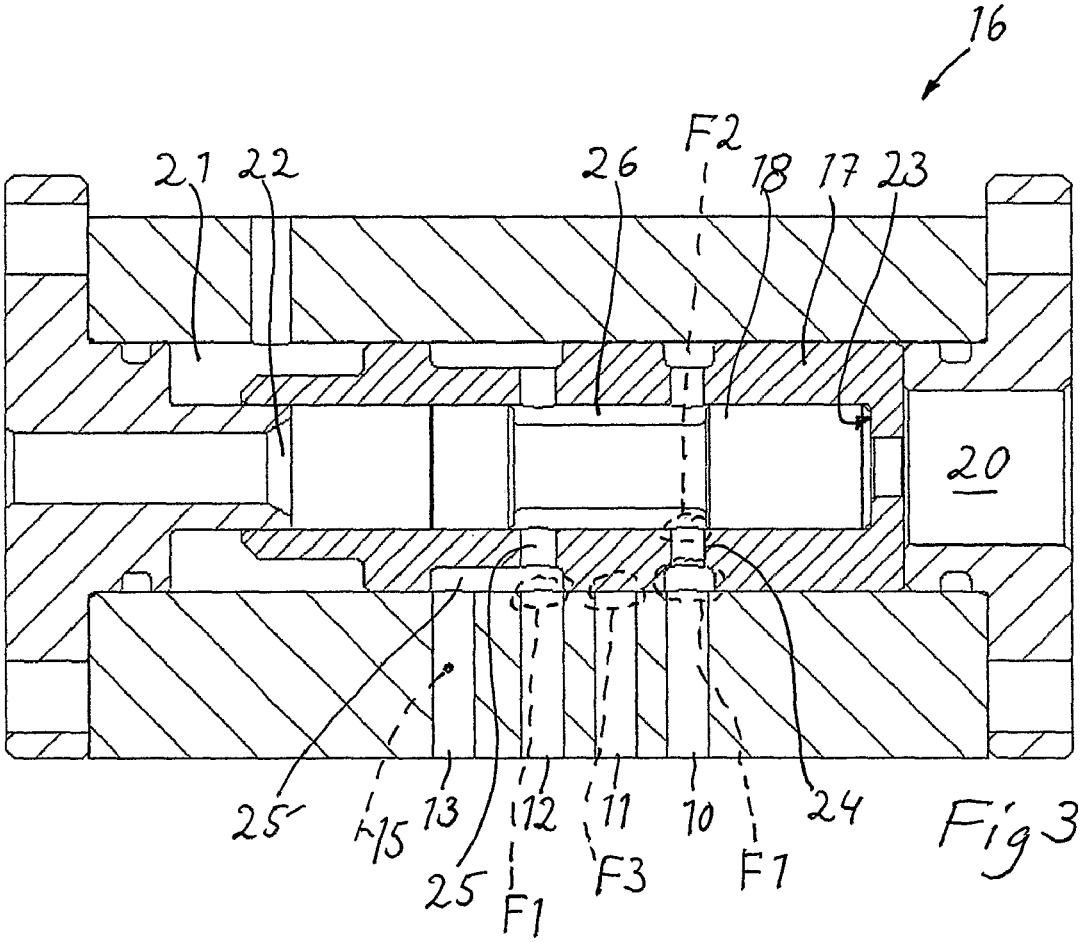

In FIG. 3*d* the control pressure $P_1$ prevails in the control chamber 21 and the control pressure $P_2$ in the control chamber 22. The first valve element 17 is in its second position, the same as in FIG. 3*b*, whereas the second valve element 18 is also in its second position lying against the inward directed shoulder 23. The result of this is that the control channel 10 has fluid connection with the control channel 13 and thereby with the signal conduit 15 over the channel portions 24 and 25 and the turned out cavities 26 and 25'. The portions F1 and F2 are open. The turned out cavity 26 in the second valve element 18 and the inner surface of the first valve element 17 together with the upper parts of the valve portions 24 and 25 constitute, as is indicated above, an open connection.

FIGS. 4*a*-4*d* show an alternative embodiment of the present invention, wherein in a valve means 16', three valve bodies 30-32 acting against respective valve seats are arranged to control opening and blocking respectively of one control channel each. Also in this embodiment only two control pressures are needed for its actuation.

Figure 4A:
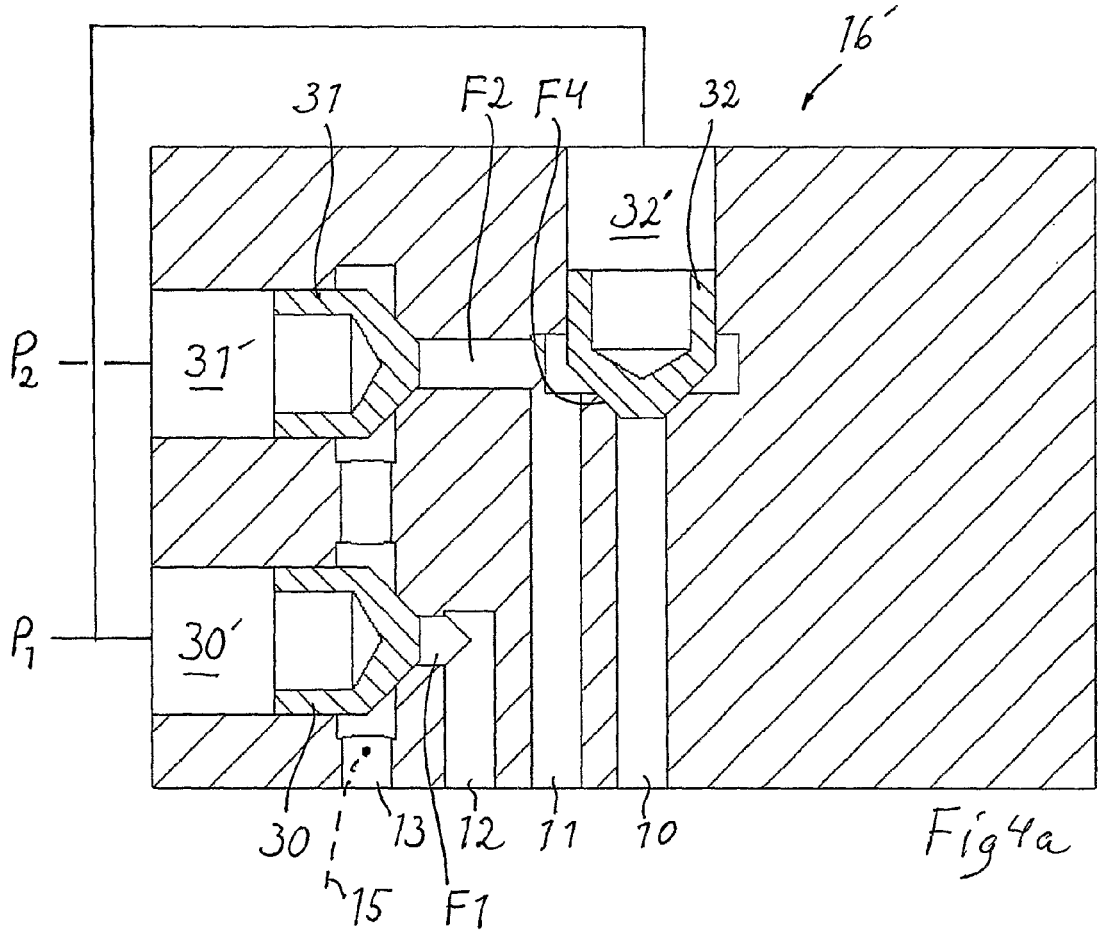
FIG. 4*a-d* shows in sections another valve means according to the invention in different settings.

With a first control pressure $P_1$ in the control chambers 30' and 32', both valve elements 30 and 32 are in their first positions, wherein the connection portion F1 (through the valve element 30) is blocked and thereby the connection between control channels 10 and 12 as well as the control valve. Through a second control pressure $P_2$ in the control chamber 31', the valve element 31 in its first position, whereby the connection portion F2 between the respective control channels and the control valve is blocked and thereby the control channel 11 (and also the control channel 10), which is shown in FIG. 4*a*.

Figure 4B:
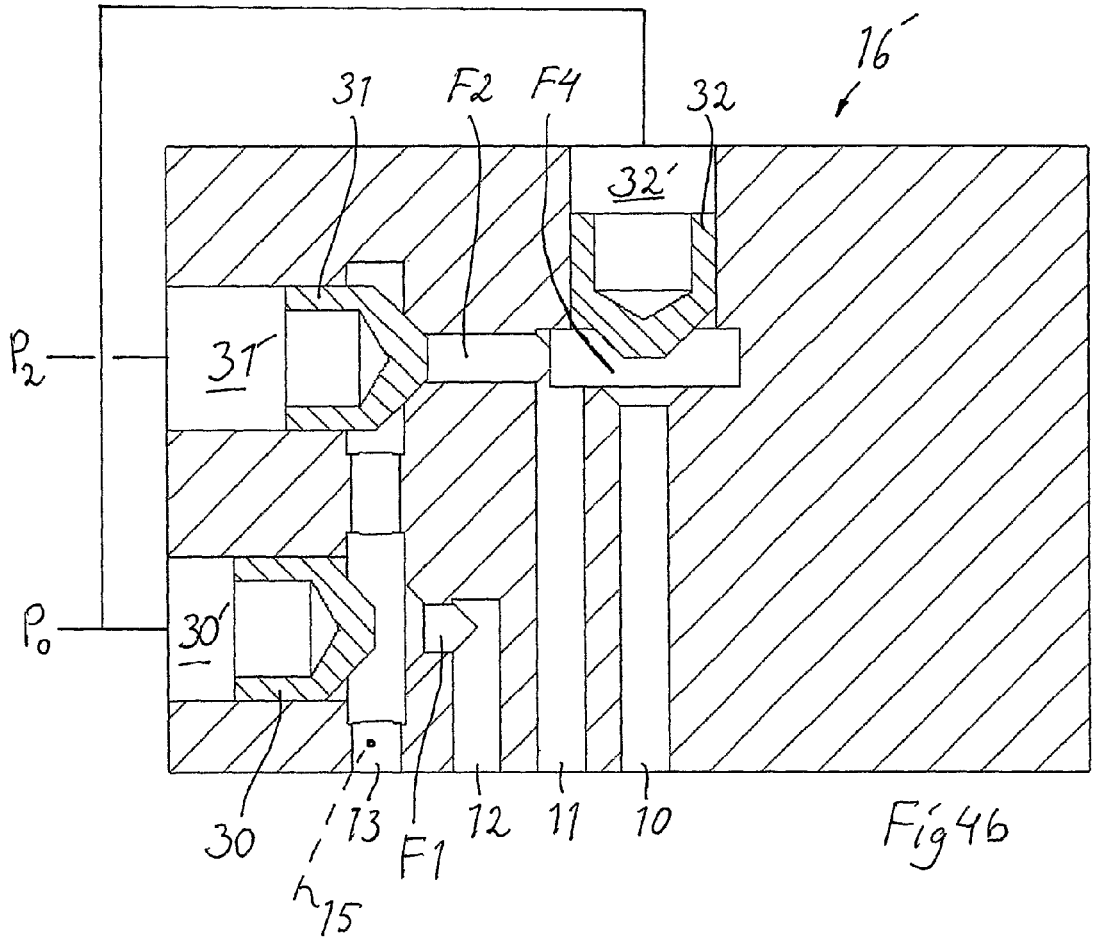

By switching control pressure such that in the control chamber 30' a lower pressure $P_0$ prevails, it is provided an open connection with control channel 10 as well as 12. The connection portion F1 is open, but because the second control pressure $P_2$ prevails in the control chamber 31, the connection portion F2 is blocked and thereby the connection between the control valve and the control channel 11 (and also the control channel 10), which is shown in FIG. 4*b*.

Figure 4C:
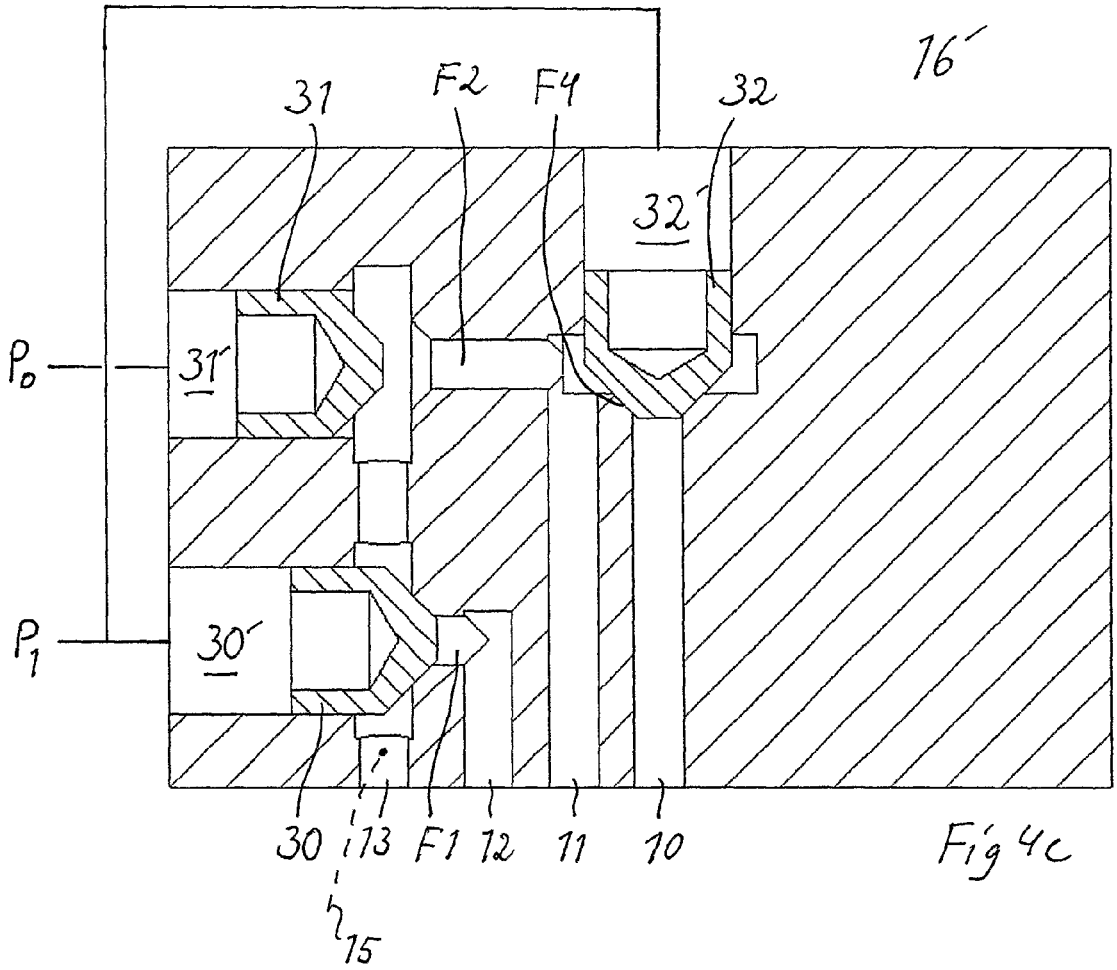

Because the first control pressure $P_1$ prevails in the control chambers 30' and 32', the control chamber 10 as well as 12 are blocked, and by a lower pressure $P_0$ prevailing in the control chamber 31', it is provided an open connection with the control channel 11 which is shown in FIG. 4*c*. The connection portion F2 is open.

Figure 4D:
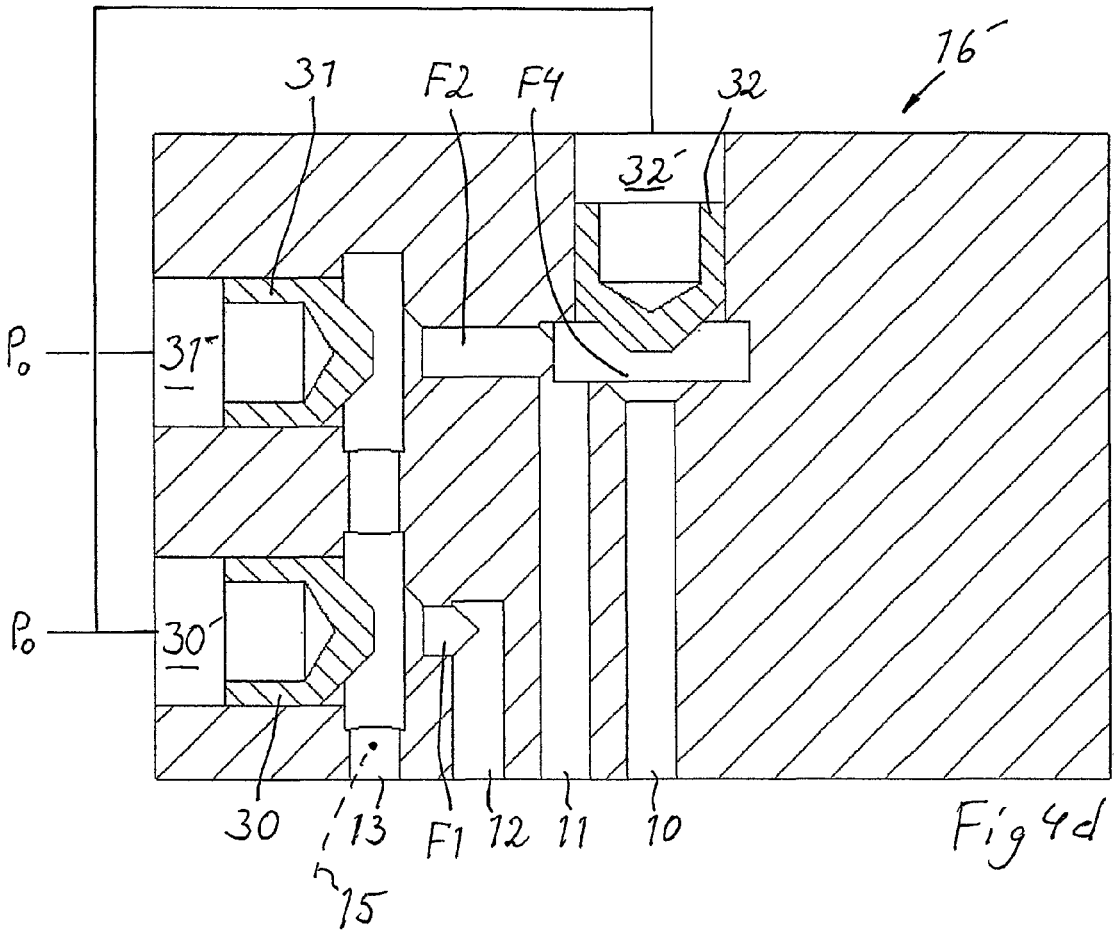

Since in all control chambers 30', 31' and 32' the lower pressure $P_0$ prevails, the connection portions F1 and F2 are open. Further, a connection portion F4 between the upper part of the control channel 10 and the portion F2 is open. Thus is provided an open connection with all control channels 10-12, which is shown in FIG. 4*d*.

Other different valve embodiments can come into question for achieving the desired function.

Altogether, the longest strike length of the percussive piston is achieved if all control channels 10, 11 and 12 are blocked such that only the control channel 13 communicates with the signal conduit 15, whereby the valve 5 is switched at a late stage of the return movement of the percussive piston. Shortest strike length is achieved if the control channel 10 communicates with the signal conduit 15, whereby the valve 5 is switched at an early stage of the return movement of the percussive piston.

Figure 5:
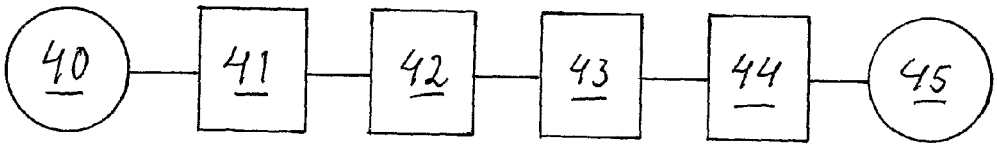
FIG. 5 illustrates a block diagram over a method wherein the invention is employed.

In FIG. 5 is indicated a method sequence for obtaining a strike in a percussive device, wherein:

Position 40 indicates start of the sequence.

Position 41 indicates generating a strike in a percussive device.

Position 42 indicates obtaining a parameter signal concerning a parameter describing the drilling process such as a pressure in a damping chamber.

Position 43 indicates analyzing the signal obtained in position 42 and generating a signal for switching the valve element in correspondence thereto for modifying the strike length of the percussive piston.

Position 44 indicates generating a strike in the percussive device with the modified stroke length.

Position 45 indicates the end of the sequence.

The invention can be modified further within the scope of the following claims. The percussion device can work according to the different principles besides what is shown on FIG. 1, with permanently applied pressure in the striking direction of the percussive piston and alternating pressurizing for the return stroke or vice versa.

The invention can be applied for controlling the upper turning position of the percussive piston as well as its lower turning position. It can also be applied in applications without rotational unit and damper, for example on so called breakers.

The invention claimed is:

1. A percussion device including, inside a machine housing, a reciprocally moveable percussive piston, the movement of which being controllable through a control valve, which is arranged to alternatively connect a chamber to a pressure source and to low pressure in dependence of a signal describing the axial position of the percussive piston, wherein inside said chamber a drive face on the percussive piston is received, wherein a plurality of axially separated control channels for transmitting said signal have openings in a cylinder space for the percussive piston in order to co-operate with a control edge on the percussive piston, and wherein valve means are provided to control the position of the control valve and are arranged to allow adjustment of in which axial position of the percussive piston said signal is transmitted, through respectively opening and blocking of connection between one or a plural of said control channels and the control valve, said valve means being disposed between each of said control channels and said control valve, wherein—said valve means includes a first valve element, which is controllable between a first position, wherein it is arranged to block a first portion or portions of a respective connection between a first subset of control channels and the control valve and a second position, wherein it is arranged to open said first portion or portions, and wherein said valve means also includes a second valve element which is controllable between a first position, wherein it is arranged to block a second portion or portions of a respective connection between a second subset of the control channels and the control valve and a second position, wherein it is arranged to open said second portion or portions, said first and second valve elements are arranged to be movable relative to each other.

2. A percussion device according to claim 1, wherein the first subset of control channels includes: one control channel or two control channels.

3. A percussion device according to claim 2, wherein the second subset of control channels includes: one control channel or two control channels.

4. A percussion device according to claim 1, wherein the second subset of control channels includes: one control channel or two control channels.

5. A percussion device according to claim 1, wherein in the second position of the second valve element, the first valve element in it's first position is arranged to open a connection portion (F3) between a control channel and the control valve and in the second position is arranged to open a connection portion (F1) between a second control channel and the control valve.

6. A percussion device according to claim 1, wherein the valve elements are circular cylindrical.

7. A rock drilling machine including a percussion device according to claim 1.

8. A percussion device including, inside a machine housing, a reciprocally moveable percussive piston, the movement of which being controllable through a control valve, which is arranged to alternatively connect a chamber to a pressure source and to low pressure in dependence of a signal describing the axial position of the percussive piston, wherein inside said chamber a drive face on the percussive piston is received, wherein a plurality of axially separated control channels for transmitting said signal have openings in a cylinder space for the percussive piston in order to co-operate with a control edge on the percussive piston, and wherein valve means are arranged to allow adjustment of in which axial position of the percussive piston said signal is transmitted, through respectively opening and blocking of connection between one or a plural of said control channels and the control valve, wherein—said valve means includes a first valve element, which is controllable between a first positions, wherein it is arranged to block a first portion or portions of a respective connection between a first subset of control channels and the control valve and a second position, wherein it is arranged to open said first portion or portions, and wherein said valve means also includes a second valve element which is controllable between a first position, wherein it is arranged to open said first portion or portions, and wherein said valve means also includes a second valve element which is controllable between a first position, wherein it is arranged to block a second portion or portions of a respective connection between a second subset of the control channels and the control valve and a second position, wherein it is arranged to open said second portion or portions, wherein the valve elements are circular cylindrical, and wherein the second valve element is arranged concentrically inside the first valve element and has recesses co-operating with channel portions, which extend radially through the material of the first valve element for opening and blocking respectively of said connection portions.

9. A percussion device according to claim 1, wherein it includes a third valve element which is controllable simultaneously with the first valve element between a first position, wherein it is arranged to block a connection portion (F4) between the control valve and a set of control channels and a second position, wherein it is arranged to open said connection portion (F4) between the control valve and a set of said control channels.

10. A percussion device according to claim 9, wherein the valve elements are switchable through pressure fluid actuation.

11. A percussion device according to claim 9, wherein the valve elements are switchable as a response to a parameter describing a drilling process.

12. A percussion device according to claim 11, wherein said parameter is any one from the group: drilling rate, pressure in a damping chamber, sensed shock wave amplitude.

13. A percussion device according to claim 1, wherein an upper control channel, positioned axially in a direction most distant from a striking direction, is permanently connected with the control valve.

14. A method for controlling a percussion device including, inside a machine housing, a reciprocally moveable percussion piston, the movement of which being controlled by a control valve, which in dependence of a signal transmitting the axial position of the percussive piston alternatively connects a chamber to a pressure source and to low pressure, wherein inside said chamber, a drive face of the percussive piston is positioned, wherein a plurality of axially separated control channels for transmitting said signal have openings in a cylinder space receiving the percussive piston for co-operation with a control edge on the percussive piston, and wherein valve means are provided to control the position of the control valve and are arranged in order to allow adjustment of in which axial position of the percussive piston said signal is transmitted, by respective opening and blocking of connection between one or a plurality of said control channels and the control valve, said valve means being disposed between each of said control channels and said control valve, wherein—said valve means includes a first valve element, which is controlled between a first position, in which it blocks a first portion or portions (F2) of a respective connection between a first subset of the control channels and the control valve, and a second position, wherein it opens said first portion or portions, and wherein said valve means also includes a second valve element, which is controlled between a first position, wherein it blocks a second portion or portions (F2) of a respective connection between a second subset of the control channels and control valve and a second position, wherein it opens said second portion or portions, said first and second valve elements arranged to be movable relative to each other.

15. A method according to claim 14, wherein in the second position of said valve element, the first valve element in the first position opens a connection portion (F3) between a control channel and the control valve and in the second position opens a connection portion (F1) between a second control channel and the control valve.

16. A method according to claim 15, wherein the percussion device includes a third valve element, which is controlled simultaneously with the first valve element between a first position, wherein it blocks a connection portion (F4) between the control valve and a set of control channels and a second position, wherein it opens said connection portion (F4) between the control valve and said set of control channels.

17. A method according to claim 14, wherein the percussion device includes a third valve element, which is controlled simultaneously with the first valve element between a first position, wherein it blocks a connection portion (F4) between the control valve and a set of control channels and a second position, wherein it opens said connection portion (F4) between the control valve and said set of control channels.

18. A method according to claim 14, wherein the valve elements are switched over through pressure fluid actuation in response to a parameter describing the drilling process.

19. A method according to claim 18, wherein said parameter is any one from the group: drilling rate, pressure in a damping chamber, sensed shock wave amplitude.

* * * * *

UNITED STATES PATENT AND TRADEMARK OFFICE

CERTIFICATE OF CORRECTION

PATENT NO. : 8,069,928 B2
APPLICATION NO. : 12/309987
DATED : December 6, 2011
INVENTOR(S) : Peter Birath It is certified that error appears in the above-identified patent and that said Letters Patent is hereby corrected as shown below:

Column 7, Line 31 (Claim 8, Line 17): Delete “positions” and substitute --position--.

Signed and Sealed this
Thirty-first Day of January, 2012

David J. Kappos

David J. Kappos
*Director of the United States Patent and Trademark Office*